US005536327A

United States Patent [19]

Kaiser

[11] Patent Number: 5,536,327

[45] Date of Patent: Jul. 16, 1996

[54] REMOVAL OF HYDROCARBON OR FLUOROCARBON RESIDUES USING COUPLING AGENT ADDITIVES

[75] Inventor: Robert Kaiser, Winchester, Mass.

[73] Assignee: Entropic Systems, Inc., Winchester, Mass.

[21] Appl. No.: 342,831

[22] Filed: Nov. 21, 1994

[51] Int. Cl.[6] ..... B08B 3/08; B08B 3/12; B08B 7/02; C23G 5/02

[52] U.S. Cl. ..... 134/1; 134/25.4; 134/26; 134/34; 134/40; 134/42

[58] Field of Search ..... 134/26, 40, 25.4–42, 134/34

[56] References Cited

U.S. PATENT DOCUMENTS

| | | | |
|---|---|---|---|
| 3,784,471 | 1/1974 | Kaiser | 252/21 |
| 4,055,049 | 10/1977 | Murphy et al. | 60/651 |
| 4,157,310 | 6/1979 | Hutchinson et al. | 252/364 |
| 4,164,471 | 8/1979 | Hutchinson et al. | 252/1 |
| 4,711,256 | 12/1987 | Kaiser | 134/25.4 |
| 5,250,213 | 10/1993 | Rozen et al. | 252/162 |
| 5,259,983 | 11/1993 | Van Der Puy et al. | 252/171 |
| 5,268,120 | 12/1993 | Michaud | 252/162 |
| 5,273,592 | 12/1993 | Chi Li | 134/40 |
| 5,298,083 | 3/1994 | Van Der Puy et al. | 134/42 |

OTHER PUBLICATIONS

Rabolt et al., 17 *Macromolecules* 2786 (1984).
Russell et al., 19 *Macromolecules* 1137 (1986).
Turberg, 110 *JACS* 7797 (1988).
Twieg et al., 21 *J. Pol. Sci* 90 (1983).
Hopken et al., 189 *Makromol. Chem* 911 (1988).
Guo–Xi et al., 261 *Colloid and Polymer Sci* 89–91 (1983).
Twieg et al., 18 *Macromolecules* 1361 (1985).
Gaines, Jr., 7 *Langmuir* 3054 (1991).
Zhao Guo–Xi et al., 261 *Colloid & Polymer Sci.* 89 (1983).
Mukerjee, 59 *JACS* 573 (1982).
Miyamoto et al., 22 *Macromolecules* 3540 (1989).
Morito et al., 67 *Colloids and Surfaces* 81 (1992).
Abe et al., 8 *Langmuir* 763 (1992).
Apte et al., 14 *J. Dispersion Sci. and Tech.* 517 (1993).
Nivet et al., 13 *J. Dispersion Sci. and Tech.* 627 (1992).
Riess et al., 13 *J. Dispersion Sci. and Tech.* 349 (1992).
Excerpt from E. Kissa, *Florinated Surfactants* (1994).

*Primary Examiner*—Zeinab El-Arini
*Attorney, Agent, or Firm*—Cesari and McKenna

[57] ABSTRACT

Fluorocarbon/hydrocarbon coupling agents are used in conjunction with highly fluorinated or, alternatively, hydrocarbon carrier liquids to remove refractory soils from solid substrates. To remove hydrocarbon soils, such as oils and greases, the coupling agent is combined with a highly fluorinated carrier liquid and the substrate exposed thereto. To remove fluorocarbon soils, a hydrocarbon carrier is used instead.

18 Claims, No Drawings

REMOVAL OF HYDROCARBON OR FLUOROCARBON RESIDUES USING COUPLING AGENT ADDITIVES

BACKGROUND OF THE INVENTION

1. Field of the Invention

The present invention relates to cleaning of solid substrates, and in particular to compositions and methods for removing hydrocarbon or fluorocarbon residues from such substrates.

2. Description of the Related Art

The persistence of residual oils and greases on a wide variety of manufactured items, particularly articles machined from metal, has long proven problematic. If left on the article, such residues can impose difficulties ranging from inconvenience in handling to measurable performance degradation. The latter is particularly common in high-precision applications where even slight deviations in surface characteristics or frictional properties can seriously interfere with component operation.

Traditional approaches to removal of oils and greases involve dissolution. The soiled article is immersed in a liquid having high solvency power with respect to the adsorbed material, which is thereby removed from the surface. However, if the substrate is not exposed to the solvent for long periods of time, at least some adsorbed surface residue will remain due to mass-transfer limitations and powerful valence forces between the surface and the innermost soil layers. This limitation is exacerbated as the solvent becomes saturated with soil. The need for strong solvency action has also led to the use of chemicals that are environmentally harmful (e.g., chlorofluorocarbons), toxic (e.g., chlorocarbons), and/or dangerously flammable (e.g., alkanes).

As an alternative, industry has adopted cleaning techniques utilizing various types of surface-active agents, or surfactants, which facilitate the use of environmentally benign solvents that ordinarily would not act on typical soils. The molecular structures of surfactants are amphiphilic, containing a solvent-soluble (usually polar) lyophilic part and a lyophobic part (usually nonpolar) compatible with soils but insoluble in the solvent. The strong interaction between the polar molecular region and the polar solvent is exploited to "drag" soils into micelle structures, which disperse throughout the solvent and away from the substrate.

Unfortunately, traditional surfactant-based cleaning mixtures exhibit certain limitations. Most are aqueous solutions, and not all substrates are compatible with water; for example, metal items can corrode, and electronic equipment can be destroyed if immersed in water-based cleaning media. Furthermore, water, with its high heat of evaporation, requires significant time to air dry. More volatile solvents offer dry-to-dry cleaning cycles under ambient or modestly elevated temperatures; such solvents, however, may not be compatible with readily available surfactants. Finally, water can be difficult or expensive to obtain at the high purity levels needed for precision cleaning applications.

DESCRIPTION OF THE INVENTION

OBJECTS OF THE INVENTION

Accordingly, it is an object of the invention to provide for rapid and substantially complete cleaning of soils such as oils and greases from solid substrates.

It is another object of the invention to facilitate cleaning with solvents that are safe, nontoxic and nonflammable.

It is yet another object of the invention to provide cleaning compositions and methods that provide an alternative to traditional solvent-based and surfactant-based approaches.

A further object of the invention is to provide cleaning compositions that can be rinsed with a volatile solvent.

Still a further object of the invention is to provide non-aqueous cleaning compositions that perform comparably to aqueous compositions.

Other objects will, in part, be obvious and will, in part, appear hereinafter. The invention accordingly comprises the several steps and the relation of one or more of such steps with respect to the others and the compositions suitable to effect such steps, all as exemplified in the following summary and detailed description, and the scope of the invention will be indicated in the claims.

BRIEF SUMMARY OF THE INVENTION

The present invention utilizes solutions of fluorocarbon-hydrocarbon coupling agents, sometimes known as "semi-fluorocarbons" or "fluorinated surfactants without a hydrophile," to emulsify and dislocate hydrocarbon or fluorocarbon soils in a nonpolar carrier liquid that also functions as a cleaning solvent. Because the invention utilizes physical displacement rather than dissolution as the mechanism of soil removal, these carrier liquids can be mild and environmentally innocuous. Furthermore, because it already relies on displacement, the cleaning efficacy of the invention is enhanced by agitation (e.g., by sonication with ultrasound) to a larger degree than are solubility-based approaches.

Fluorocarbon-hydrocarbon coupling agents (referred to hereinafter, for simplicity, as "coupling agents") are generally nonpolar species having a hydrocarbon end and a perfluorinated or highly fluorinated end. (As used herein, the term "perfluorinated" refers to a chemical group in which each carbon atom is bound only to other carbon atoms and fluorine atoms; the term "highly fluorinated" refers to a compound containing at least one fluorine atom per carbon atom, with fluorine atoms constituting at least one-half of the non-carbon substituents on each carbon atom.) The carrier liquid is selected to be chemically compatible with one end of the coupling agent, the other end of which is chemically compatible with the soil. When a residue-bearing substrate is exposed to a solution containing the coupling agent, compatible portions of the latter surround and become associated with the residue. The coupling agent reduces interaction between the soil and the substrate and, because its unassociated molecular regions are compatible with the carrier liquid, encourages dissociation of the soil from the substrate and into the bulk carrier liquid.

The approach of the present invention represents a departure from conventional surfactant-based cleaning systems, since the entire coupling agent is nonpolar or only weakly so. Rather than relying on polar solvents such as water, the coupling agents of the present invention are used in conjunction with nonpolar, highly fluorinated liquids or hydrocarbons. The former liquids are well known for their particle-removal efficacy, but, being oleophobic, do not perform well on coated hydrocarbon soils. The present coupling agents effectively render this class of cleaning liquid compatible with otherwise mismatched soils.

Cleaning mixtures useful for removing hydrocarbons from a surface include one or more coupling agents combined with a highly fluorinated liquid carrier. Such liquids are both hydrophobic and oleophobic, and therefore shun interaction with hydrocarbon soils; however, highly fluorinated liquids provide an excellent emulsifying vehicle in conjunction with the coupling agents of the present invention. Cleaning mixtures useful for removing fluorocarbons from a surface include one or more coupling agents combined with a hydrocarbon carrier. The cleaning mixtures of the present invention can be azeotropes or non-azeotropic liquid combinations.

The cleaning mixtures of the present invention function best by immersion, although they can also be applied to substrates by spraying or flow techniques. Substrates having hydrocarbon or fluorocarbon residues are typically immersed in an appropriately formulated cleaning mixture. The coupling agent dislodges the residue from the substrate surface, resulting in its dispersion through the cleaning mixture; the cleaned substrate is then removed and, if appropriate, rinsed before drying.

DETAILED DESCRIPTION OF THE PREFERRED EMBODIMENTS

1. Types of Coupling Agents

The coupling agents of the present invention are nonpolar and contain hydrocarbon and perfluorinated terminal chains. Many chemical species, of varying molecular weights, satisfy these criteria; the choice of compound for a particular application depends primarily on the nature of the soil. For example, heavy, high molecular-weight soils (such as thick greases or waxy deposits) may be more effectively removed by coupling agents having a minimum chain length, since these should penetrate the soils more easily and interact more strongly with the carrier liquid.

Useful alkane coupling agents are described by the chemical formula $$CH_3—(CH_2)_m—L—(CF_2)_n—CF_3$$

where L is a transition linkage. Most simply, L is no more than a direct carbon-carbon bond between the last —$CH_2$— group and the first —$CF_2$— group. However, L can also be an ester, ketone, ether, amide, imide or other organic linking group. Preferred molecular weights range widely. At the low end, compounds as small as $CH_3—(CF_2)_3—CF_3$ (in a perfluorinated solvent) or $CF_3—(CH_2)_3—CH_3$ (in a hydrocarbon solvent) can prove effective, while higher-weight polymeric species having molecular weights of 4000 daltons or more can also be used advantageously. Preferably, in order to remove a wide range of soils, the coupling agent has a molecular weight of at least 500.

For coupling agents used in perfluorinated solvents, the hydrocarbon end of the molecule can be varied substantially. Branched or cyclic alkanes, ethers or polyethers, as well as aromatic groups can be included. Preferably, however, in such applications the fluorocarbon end of the molecule is a straight-chain perfluoroalkane as described above or a perfluoroether of the general formula $CF_3—[(CR^1R^2)_mO]_n—$, where $m \geqq 1$, $n \geqq 1$, and $R^1$ and $R^2$ are each a fluorine atom, —$CF_3$ or a longer-chain fluoroalkane. For example, as discussed in greater detail below, successful results have been obtained with esters of an aliphatic or aromatic alcohol and a perfluorinated polyether carboxylic acid.

The opposite logic prevails when the solvent is used in a hydrocarbon solvent to remove fluorinated soils. In this case, the fluorocarbon end of the molecule can be relatively short and varied substantially, since its precise chemical identity is not critical to cleaning efficacy.

The coupling agents are preferably mixed with a carrier liquid in concentrations ranging from 0.1 wt % to 10.0 wt %, although larger percentages may prove desirable in some circumstances. For example, a minimum amount of coupling agent is ordinarily necessary to adequately clean a given soil, but reuse of the mixture depletes the concentration of coupling agent over time. Larger concentrations, therefore, prolong the useful life of the cleaning mixture.

2. Useful Carrier Liquids

In applications involving removal of hydrocarbon soils, highly fluorinated liquids are preferred as carriers. Useful examples include perfluorohexane, perfluoroheptane, perfluoromethylmorpholine, perfluoroethyl-morpholine, and azeotropes of fluorocarbons or fluorocarbons and hydrocarbons (e.g., a 90%/10% azeotrope of perfluoroethylmorpholine and tetramethylbutane). All of the foregoing materials are readily purchased from suppliers such as 3M, 3M Center, St. Paul, Minn.

Another useful class of carrier fluid is hydrofluorocarbons, or "HFCs", which are highly fluorinated liquids that contain at least one hydrogen atom in the molecule. Examples of this type of liquid include 6H-perfluorohexane, HFC 4310mee (supplied by E. I. duPont de Nemours, Wilmington, De.) and HFC-356mcf (supplied by Allied Signal Corp., Morristown, N.J.).

In applications involving removal of fluorocarbon soils, good results are obtainable with aliphatic hydrocarbons such as hexane, cyclohexane, octane and the like; ethers, such as isopropyl ether; and aromatic species such as benzene or toluene.

3. Cleaning Techniques

Preferred cleaning operations that employ the coupling agents of the present invention are of the immersion type. Recirculating systems, such as those described in U.S. Pat. No. 4,711,256 (to Kaiser, entitled METHOD AND APPARATUS FOR REMOVAL OF SMALL PARTICLES FROM A SURFACE) and copending application Ser. No. 08/317,382, entitled AUTOMATIC PRECISION CLEANING APPARATUS WITH CONTINUOUS ON-LINE MONITORING AND FEEDBACK and filed on Oct. 4, 1994 (both of which are hereby incorporated by reference in their entireties) are advantageously employed. Preferred systems provide continuous filtration of the cleaning liquid as the immersed substrate is washed, followed, if appropriate, by a rinsing cycle. It should be stressed, however, that other traditional cleaning apparatus, such as spray-type systems and vapor degreasers, can also be used to advantage. It is preferred to employ agitation, most preferably using ultrasound, to promote and quicken the cleaning process. The cleaned article is dried after washing (or rinsing) has been completed.

In a first series of experimental procedures, substrates coated with hydrocarbon oils and greases were cleaned in various cleaning mixtures consisting of combinations of highly fluorinated carrier liquids and ester-linked coupling agents. Cleaning efficacy was evaluated by comparison with reagent-grade dichloroethane ("DICE"), a standard cleaning agent.

The following carrier liquids were examined: perfluoroheptane (3M's PF-5070); perfluoromethylmorpholine (3M's PF-5052); perfluoroethylmorpholine (3M's PF-5062); and a 90%/10% azeotrope of PF-5062 and tetramethylbutane (3M's L12862).

Tests were performed with dilute solutions of the following coupling agents, combined in proportions ranging from 1.7 to 2.0 wt % in the above-mentioned carrier liquids: octyl ester of poly(hexafluoropropylene oxide) ("HFPO") carboxylic acid (designated R134); dodecyl ester of HFPO acid (designated R135); hexadecyl ester of HFPO acid (designated R136); Triton X-35 ester of HFPO acid (designated R137); oleyl ester of HFPO acid (designated R143); and the unmodified HFPO acid. The HFPO acid (specifically, the KRYTOX 157 FSL product obtained from E. I. dupont de Nemours, Wilmington, Del.) had a molecular weight of approximately 2800, based on acid number. Triton X-35, obtained from Sigma Chemical Company, St. Louis, Mo. is an ethoxy adduct of octylphenol with an average of 2.5 ethoxy groups per molecule.

The substrates employed were glass slides (7.5 cm in length, 1 cm in width and 0.10 cm thick) cleaned with acetone prior to being coated with the test contaminants. These were SAE 40 motor oil (manufactured for NAPA by Mac's Oil & Chemicals, Inc., Lexington, Ky.); SAE 80w-85w-90 gear oil (also supplied to NAPA by Mac's Oil & Chemicals); LUBRIMATIC heavy-duty, multipurpose lithium grease (obtained from Witco Corp., Olathe, Kans.), and high-vacuum silicone grease (obtained from Dow Corning, Inc., Midland, Mich.). In each case, the lower end of a tared slide was coated with a known amount (about 200 mg) of contaminant on both sides.

Immersion cleaning of the slides was performed in 24-ml glass vials each sealed with an open-top plastic screw cap that had been fitted with a PTFE-faced flat-disk rubber septum. The substrates were fixtured in the vials by inserting one end through a slit in the rubber septum. The cleaning operation was performed by subjecting each slide to two wash cycles in a given cleaning mixture, followed by one rinse cycle in the pure carrier liquid. A wash cycle consisted of dipping a slide into a vial containing approximately 20 ml of fresh cleaning mixture, tightening the cap, and sonicating the vial and its contents for 5 min. under constant temperature conditions. The final rinse cycle was similar to the wash cycles except that the sonication time was 2 min. The wash and rinse cycles were performed at temperatures ranging from 100° to 140° F.

The results of these experiments are as follows:

TABLE 1

| Cleaning Medium | Temp. °F. | Residual Wt % Of The Contaminants On The Slides | | | |
|---|---|---|---|---|---|
| | | SAE40 Motor Oil | 80w85w90 Gear Oil | Lithium Grease | Silicone Grease |
| Pure PF5070 | 100 | 70.0 | 71.3 | — | — |
| R134/PF5070 | | 20.0 | 61.4 | — | — |
| R135/PF5070 | | 12.0 | 50.0 | — | — |
| R136/PF5070 | | 12.0 | 56.4 | — | — |
| R137/PF5070 | | 41.6 | 67.2 | — | — |
| Pure PF5070 | 140 | 63.2 | 68.8 | 74.3 | 98.3 |
| R134/PF5070 | | 26.4 | 34.6 | — | — |
| R135/PF5070 | | 18.8 | 22.5 | — | — |
| R136/PF5070 | | 36.4 | 28.6 | 25.8 | 37.8 |
| R137/PF5070 | | 70.6 | 62.0 | — | — |
| Krytox 157 FSL/ PF5070 | | 32.3 | 26.1 | 13.2 | 8.7 |
| Pure PF5052 | 100 | 58.9 | 69.5 | — | — |
| R134/PF5052 | | 33.2 | 49.7 | — | — |
| R135/PF5052 | | 32.2 | 53.2 | — | — |
| R136/PF5052 | | 38.2 | 56.7 | — | — |
| R137/PF5052 | | 42.2 | 63.3 | — | — |
| Pure PF5062 | 140 | 33.0 | 19.9 | 59.8 | 80.7 |
| R143/PF5062 | | 3.1 | 6.5 | 61.0 | 84.5 |
| Pure L12862 | 100 | 25.5 | 15.0 | — | — |
| R134/L12862 | | 0.6 | 14.6 | — | — |
| R135/L12862 | | 0.3 | 14.7 | — | — |
| R136/L12862 | | 0.4 | 14.6 | — | — |

TABLE 1-continued

| Cleaning Medium | Temp. °F. | Residual Wt % Of The Contaminants On The Slides | | | |
|---|---|---|---|---|---|
| | | SAE40 Motor Oil | 80w85w90 Gear Oil | Lithium Grease | Silicone Grease |
| R137/L12862 | | 18.2 | 19.2 | — | — |
| Pure L12862 | 140 | 18.2 | 13.7 | 12.5 | 100 |
| R134/L12862 | | 0.1 | 0.4 | 1.4 | 3.2 |
| R135/L12862 | | 0.2 | 0.3 | 1.1 | 9.0 |
| R136/L12862 | | 0 | 0.1 | 2.1 | 17.2 |
| R137/L12862 | | 18.6 | 0.3 | 2.8 | 41.8 |
| R143/L12862 | | 0.3 | 0.1 | 8.5 | 3.8 |
| Krytox 157 FSL/ L12862 | | 38.9 | 15.7 | 16.7 | 11.0 |
| DICE | 100 | 0.1 | 0.2 | — | — |
| DICE | 140 | — | — | 15.3 | 11.7 |

These experiments confirm the utility and advantage of the present invention. Along with other experiments carried out to date, they indicate that extent of contaminant removal depends on the cleaning formulation, the nature of the substrate, the type of soil, and the cleaning temperature. In general, the best results were obtained by sonicating at 140° F. in mixtures of a simple ester coupling agent in L12862 azeotrope. These solutions removed by emulsification the four soils examined at least as effectively as did DICE. Furthermore, solutions of the coupling agents were observed to remove soils better than the pure perfluorinated carrier liquids or solutions containing the unmodified HFPO acid.

For example, while the pure azeotrope removed a significant fraction (up to 90%) of the soils, addition of simple ester coupling agents (i.e., R134, R135, R136 and R143) resulted in essentially complete soil removal at 140° F. The mixtures that included R137 were largely ineffective; this is presumed due to the presence, on the Triton X-35 ester, of polar ethoxy groups, which would be expected to inhibit both solubility of the coupling agent in the carrier liquid and its interaction with the nonpolar soils. The best R137 performance was obtained in connection with the slightly more polar lithium grease, suggesting that this mixture might prove effective in removing even more polar materials such as rosin fluxes.

Significantly more emulsification was observed with the azeotrope solutions than with the other solutions. The two oils examined in the experiments formed fairly stable emulsions in the pure azeotrope with a cohesive floating layer of oil that coated the vessel walls. With the greases, a floating layer of grease particles was observed. SAE 40 motor oil formed a very stable emulsion in the cleaning mixtures that contained simple esters. Although the emulsion did not separate under the influence of gravity, it was filterable, and filtering this emulsion through a 0.2-micron filter resulted in a clear filtrate. The heavier gear oil formed a somewhat coarser emulsion that separated more rapidly. Temperature had a significant on the characteristics of the emulsified soils; increasing the temperature from 100° to 140° F. tended to produce coarser droplets that separated more readily from the cleaning medium.

In a second series of experimental procedures, substrates coated with hydrocarbon oils and greases were cleaned in various cleaning mixtures consisting of combinations of an HFC and ester-linked coupling agents. Cleaning efficacy was evaluated by comparison between the pure HFC and the HFC/coupling agent combination, using the experimental procedures outlined above. The HFC examined was 6H-perfluorohexane, obtained from PCR Inc., Gainesville, Fla., and the coupling agent was lauryl alcohol KRYTOX ester (designated R160); when employed, the coupling agent was present at a concentration of 1.9 wt %.

The results of this second set of experiments are as follows:

TABLE 2

| | | | | |
|---|---|---|---|---|
| Date of Test | 10/19/94 | 10/19/94 | 10/19/94 | 10/19/94 |
| Slide No. | AH1 | AH2 | AH3 | AH4 |
| Run Nos. | 370–370A | 371–371A | 372–374 | 375–377 |
| Substrate | GLASS | GLASS | GLASS | GLASS |
| Soil | Silicone grs. | SAE 40 OIL | Silicone grs. | SAE 40 OIL |
| Test Temperature, °F. | 140 | 140 | 140 | 140 |
| CLEANING LIQUID | | | | |
| Carrier Liquid | HFC | HFC | HFC | HFC |
| Additive | — | — | R160 | R160 |
| Additive Concentration, wt-% | 0 | 0 | 1.9 | 1.9 |
| GRAVIMETRIC ANALYSIS | | | | |
| Initial Weight of Slide & System, gr | 22.39342 | 21.73389 | 21.74862 | 21.88009 |
| Weight of Slide & System with Soil, gr | | | | |
| Before Cleaning | 22.42988 | 21.75492 | 21.78417 | 21.90224 |
| After Cleaning | 22.42500 | 21.74296 | 21.76652 | 21.88154 |
| Weight of Soil Initially Added, gr | 0.03646 | 0.02103 | 0.03555 | 0.02215 |
| Weight of Residual Soil After Cleaning, gr | 0.03158 | 0.00907 | 0.01790 | 0.00145 |
| Weight of Soil Removed, gr | 0.00488 | 0.01196 | 0.01765 | 0.02070 |
| Weight Percent of Soil Residue | 86.6% | 43.1% | 50.4% | 6.5% |
| Weight Corrections | | | | |
| Weight Correction for Solvent Absorption, gr | 0 | 0 | 0 | 0 |
| Corrected Residual Weight, gr. | 0.03158 | 0.00907 | 0.01790 | 0.00145 |
| Corrected Weight of Soil Removed, gr. | 0.00488 | 0.01196 | 0.01765 | 0.02070 |
| Corrected Weight Percent of Soil Residue | 86.6% | 43.1% | 50.4% | 6.5% |

The cleaning efficacy of the HFC on both soils tested was substantially improved through addition of the coupling agent. The residual weight of silicone grease was reduced from 86.6% to 50.4%, while the residual weight of SAE 40 oil was reduced from 43.1% to 6.5%, as measured by gravimetric analysis.

It will therefore be seen that I have developed a highly effective and versatile approach to removal of hydrocarbon and fluorocarbon soils from solid substrates. The terms and expressions employed herein are used as terms of description and not of limitation, and there is no intention, in the use of such terms and expressions, of excluding any equivalents of the features shown and described or portions thereof, but it is recognized that various modifications are possible within the scope of the invention claimed.

What is claimed is:

1. A method of cleaning hydrocarbon soils from a solid substrate, the method comprising the steps of:

a. washing the substrate in a cleaning mixture comprising a highly fluorinated carrier liquid and a coupling agent having a perfluorinated molecular region and a hydrocarbon molecular region so as to clean the substrate, the coupling agent being nonpolar and selected from a group consisting of (i) materials having a chemical formula $CH_3—(CH_2)_m—L—(CF_2)_n—CF_3$ wherein $m \geqq 0$, $n \geqq 3$, and L is a direct carbon-carbon bond or an organic linking group, and (ii) perfluoroethers having a perfluorinated molecular region of chemical formula $CF_3—[(CR^1R^2)_mO]_n—$, wherein $m \geqq 1$, $n \geqq 1$, and $R^1$ and $R^2$ are selected from a group consisting of fluorine and fluoroalkanes; and b. removing the cleaning mixture from the substrate.

2. The method of claim 1 further comprising a step of rinsing the substrate in a rinsing liquid comprising a highly fluorinated liquid.

3. The method of claim 1 wherein the coupling agent comprises at least 0.1 wt % of the cleaning mixture.

4. The method of claim 3 wherein the coupling agent comprises no more than 10.0 wt % of the cleaning mixture.

5. The method of claim 1 further comprising a step of agitating the cleaning mixture during washing.

6. The method of claim 5 wherein agitating the cleaning mixture during washing is accomplished by ultrasound sonication.

7. The method of claim 1 further comprising a step of maintaining a temperature during washing of at least 100° F.

8. The method of claim 1 wherein the coupling agent has a chemical formula $CH_3—(CH_2)_m—L—(CF_2)_n—CF_3$ wherein $m \geqq 0$, $n \geqq 3$, and L is a direct carbon-carbon bond or an organic linking group.

9. The method of claim 8 wherein the coupling agent has a molecular weight of at least 500.

10. The method of claim 1 wherein the coupling agent is a perfluoroether having a perfluorinated molecular region of chemical formula $CF_3—[(CR^1R_2)_mO]_n—$, where $m \geqq 1$, $n \geqq 1$, and $R^1$ and $R^2$ are selected from a group consisting of fluorine and fluoroalkanes.

11. The method of claim 10 wherein the coupling agent is an ester of poly(hexafluoro-propylene oxide) acid.

12. The method of claim 1 wherein the carrier liquid is a fluorocarbon/hydrocarbon azeotrope.

13. The method of claim 1 wherein the carrier liquid is a hydrofluorocarbon.

14. A method of cleaning fluorocarbon soils from a solid substrate, the method comprising the steps of:

a. washing the substrate in a cleaning mixture comprising a hydrocarbon carrier liquid and a coupling agent having a perfluorinated molecular region and a hydrocarbon molecular region so as to clean the substrate; and b. removing the cleaning mixture from the substrate.

15. The method of claim 14 further comprising a step of rinsing the substrate in a rinsing liquid consisting essentially of one or more hydrocarbons.

16. The method of claim 14 further comprising a step of agitating the cleaning mixture during washing.

17. The method of claim 16 wherein agitating the cleaning mixture during washing is accomplished by ultrasound sonication.

18. The method of claim 14 wherein the coupling agent has a chemical formula $CH_3—(CH_2)_m—L—(CF_2)_n—CF_3$ wherein $n \geqq 0$, $m \geqq 3$, and L is a direct carbon-carbon bond or an organic linking group.

* * * * *